United States Patent [19]

Verjux

[11] 4,261,236

[45] Apr. 14, 1981

[54] DEVICE FOR CONVERTING THE AXIAL MOVEMENT OF CYLINDRICAL ROD-SHAPED OBJECTS INTO A LATERAL TRANSLATION

[75] Inventor: Jean Verjux, Montgeron, France

[73] Assignee: Arenco-Decoufle, Société Anonyme Francaise, Paris, France

[21] Appl. No.: 13,388

[22] Filed: Feb. 21, 1979

[30] Foreign Application Priority Data

Feb. 20, 1978 [FR] France ..... 78 04702

[51] Int. Cl.[3] ..... B65G 47/26; A24C 5/28

[52] U.S. Cl. ..... 83/110; 83/158; 83/161; 198/457; 198/689

[58] Field of Search ..... 83/110, 112, 152, 154, 83/155.1, 158, 161; 198/457, 689

[56] References Cited

U.S. PATENT DOCUMENTS

| | | | |
|---|---|---|---|
| 2,010,486 | 8/1935 | Herrmann | 198/457 |
| 2,176,485 | 10/1939 | Bronander | 198/689 X |
| 2,580,469 | 1/1952 | Schwartz | 198/457 |
| 3,185,284 | 5/1965 | Molins | 198/689 X |
| 4,189,045 | 2/1980 | Verjux | 198/457 |

*Primary Examiner*—J. M. Meister

[57] ABSTRACT

This device for causing elongated cylindrical objects such as cigarettes delivered in the form of a continuous line to penetrate successive recesses formed in a rotary drum is of the type wherein a transfer device is interposed for accelerating the velocity of translation of the cigarettes in order to separate them from one another while imparting thereto a transverse velocity equal to the peripheral velocity of the drum recesses; this transfer device comprises a single vertical cam of which the operative portion engages the cigarette moving past underneath, when the leading end of the cigarette penetrates into a corresponding recess of the drum. The combined action of the cam and drum cause the cigarette to move transversely and parallel to itself.

6 Claims, 7 Drawing Figures

DEVICE FOR CONVERTING THE AXIAL MOVEMENT OF CYLINDRICAL ROD-SHAPED OBJECTS INTO A LATERAL TRANSLATION

BACKGROUND OF THE INVENTION

This invention relates in general to cigarette making machines and has specific reference to a transfer device therefor which is capable of converting an axial or longitudinal movement of separate cigarettes into a lateral or transverse movement of translation.

DESCRIPTION OF THE PRIOR ART

It is known that modern cigarette making machines form a continuous rectilinear rod of tobacco wrapped in a paper sheet which is subsequently cut into sections of equal length forming a continuous line of cigarettes disposed in end to end relationship.

The cigarettes are subsequently introduced into a transfer device usually referred to as a conveyor which carries the cigarettes in a direction at right angles to their longitudinal axis, i.e. laterally, while firstly slowing down and eventually stopping their longitudinal movement.

In most instances, the conveyor is a drum formed with peripheral grooves and rotatably driven at a constant velocity about an axis parallel to the axis of travel of the line of cigarettes.

Each drum groove is semi-cylindrical with a diameter of 9 to 10 mm and has a outflaring inlet end, i.e. the end through which the cigarettes are delivered to the drum, in order to facilitate the ingress of more than half a cigarette length into the drum groove, before the cigarette actually contacts one of the side walls of the groove and is carried along abruptly in a transverse direction by said wall.

The pitch of the drum grooves increases with the width of the outflared inlet portion and the peripheral speed of the drum is proportional to the groove pitch. The greater the pitch, the sharper the transverse shock applied to each cigarette.

Before their ingress into the drum grooves, the cigarettes are accelerated in order to impart thereto a speed definitely higher than the speed of the line from which the cigarettes are taken, for the purpose of reducing the time necessary for their penetration into the drum grooves, so that the width of the outflared inlet portion of each groove may be selected to be approximatively twice the diameter of the semi-cylindrical portion of the groove.

However, in modern machines operating at a rate of the order of 4,000 cigarettes per minute the cigarettes are submitted to a treatment detrimental to their intrinsic and ultimate quality; in fact, the high-speed shock applied by the side wall of the groove to the cigarette causes tobacco to be expelled from the cigarette ends and also the deformation of these ends; similarly, the braking action exerted on the cigarettes, of which the velocity was greatly increased by the preliminary acceleration, is attended by the ejection of tobacco from the front or leading end of each cigarette.

To avoid this serious inconvenience, a known proposition consists in causing the cigarettes to move transversely to their longitudinal axis before they penetrate into the drum grooves, in order to gradually impart to the cigarettes a transverse velocity preferably as close as possible to the peripheral velocity of the drum. Thus, an improvement is observed on two points: firstly, it is no more necessary to impart a substantial longitudinal acceleration to the cigarettes in order to cause them to penetrate more rapidly into the drum grooves, and it is only necessary to increase their speed by 3 to 5 percent for forming a gap of 2 to 3 mm between them and thus prevent their adjacent ends to frictionally engage each other during this transverse travel; secondly, the pitch of the drum grooves may be selected to have a value close to the cigarette diameter, thus reducing appreciably the peripheral velocity of the drum.

Under these conditions, the transverse and longitudinal forces exerted on the cigarettes are reduced considerably, and the damages and deformations of the cigarettes are also minimized.

To obtain this result, the Applicant, in their prior U.S. application Ser. No. 845,421 filed on Oct. 25, 1977 interposed between the conveyor and the continuous line of cut cigarettes disposed end to end, delivered by the cigarette making machine horizontally and parallel to the axis of rotation of the conveyor and tangent to the drum thereof, a transfer device consisting of an endless perforated tape having one run driven in a vertical plane at a speed slightly greater than the cigarette delivery speed, along one of their sides, the cigarettes being urged against the external surface of the tape by means of a vacuum produced behind the other face of the same run, between the cigarette delivery device and the conveyor, and two similar rotary cams having their axes disposed horizontally and at right angles to the direction of the incoming cigarettes, at a peripheral speed slightly greater than that of said run of the perforated tape and of the cigarettes urged thereagainst, and so arranged as to contact the upper surface of each cigarette simultaneously, so as to push this cigarette transversely downwards, parallel to itself and tangent to the drum, and to discontinue the contact with said cigarette simultaneously, when its front portion penetrates one of the drum grooves.

SUMMARY OF THE INVENTION

Now according to the present invention it has been found that this device could be simplified considerably while reducing very appreciably its over all dimensions by using only one deflection cam instead of two, the position of this deflection cam in relation to the position of the drum, and the angular timing of the cam being such that the operative portion of this cam contacts the uppermost generatrix of each cigarette only when the axis of the cigarette is in alignment with the axis of the drum groove into which it is to be penetrated by the cigarette, and when the front or leading end of the same cigarette has already penetrated into this groove, so that, as a consequence of the combined action of this cam and of the drum groove, the cigarette remains constantly parallel to itself throughout its transverse transfer, until the cigarette is received completely by the groove concerned.

Preferably, the position of this cam in relation to the groove drum position is also such that the operative portion of the cam engages the uppermost generatrix of the cigarette when the centre of gravity of the cigarette is straight under the axis of rotation of the cam.

The operative portion of the cam pushes the cigarette parallel to itself, transversely downwards, and tangent to the drum.

Perferably, this cam is rotatably driven at a number of revolutions per minute equal to the number of cigarettes manufactured by the machine per minute, and to obtain the above-defined result its operative portion comprises a first profile consisting of a curve, for example an eccentric sector, such that it imparts to the cigarette a gradually increasing transverse velocity which eventually becomes equal to the peripheral velocity of the drum grooves.

This first profile may be followed or not by a second profile connected tangentially to the first profile and consisting likewise of a curved sector such as an involute of a curve, so that the transverse velocity imparted to the cigarette be kept at a constant value equal to the peripheral velocity of the drum, at least until the cigarette has penetrated into the corresponding groove of the drum to a depth such that a vertical plane containing its centre of gravity lies within the limits of the drum vertical projection. This second profile should preferably be limited to a developed length such that the next cigarette be presented in a proper position before it is deflected by cam.

DESCRIPTION OF THE REFERRED EMBODIMENT

Figure 1:
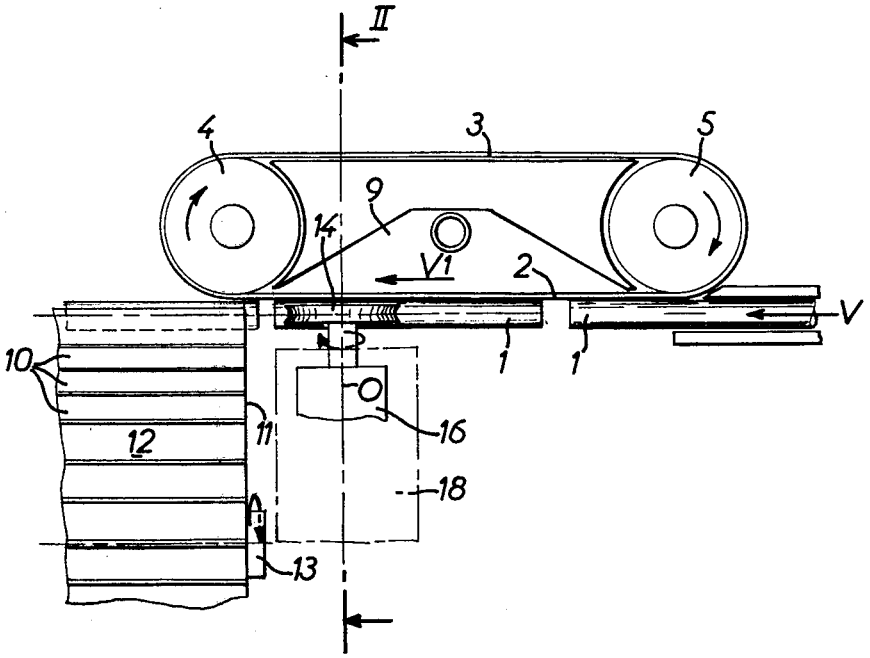
FIG. 1 is a plane view from above.
Figure 2:
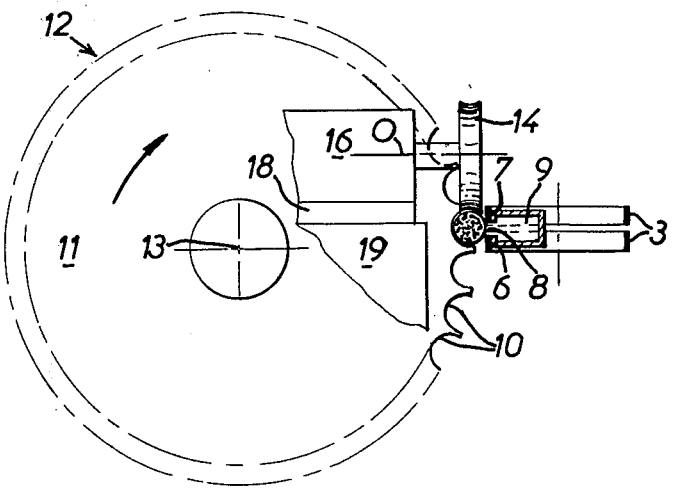
FIG. 2 is a section taken along the line II—II of FIG. 1.
Figure 3:
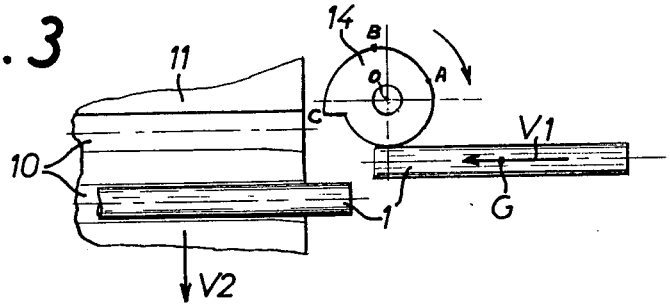
FIG. 3 is a diagrammatic front elevational view showing on a larger scale the relative positions of the cigarettes, cam and drum before the cam becomes operative.

The cigarettes 1 cut from the rod produced by the cigarette making machine are delivered in aligned end to end relationship on a single line at a velocity V and driven at a velocity $V_1$ slightly greater than V by the run 2 of an endless tape 3 passing over a pair of spaced pulleys 4 and 5 of which one is the drive pulley, this tape consisting of two parallel elements 6 and 7 separated by a gap 8 for example 5 of the order of 2 mm; this run 2 moves past a chamber 9 in which a vacuum is produced, such that the cigarettes are urged against this run 2 of the endless tape 3 for the purpose of causing the cigarettes to penetrate each into a corresponding groove or like recessor cavity 10 of the drum 11 of conveyor 12 which is also driven for rotation about its axis 13 at a peripheral velocity such that the drum grooves 10 move past at such a rate that an empty groove registers with each incoming cigarette 1.

In order to impart to the cigarettes, before they penetrate into a groove 10 of drum 11 of conveyor 12, a lateral velocity equal to the peripheral velocity of the grooves, a rotary cam 14 is rotatably mounted above the line of cigarettes 1 and tangentially to the drum, in a plane containing the axis of the cigarettes 1 and also the axis of a groove 10 located in a horizontal diametral plane of the drum 11.

Figure 7:
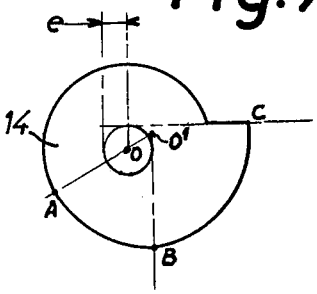
FIG. 7 is a typical embodiment of the cam.

This cam 14 consists of a disc rotating continuously about its axis 0 at a velocity of N revolutions per minute, N being the number of cigarettes produced per minute by the machine; this disc comprises a sector AB centered at 0', having a throw "e" with respect to the axis 0, and merges into another sector BC consisting of an involute of a curve, as shown on a larger scale in FIG. 7.

Figure 4:
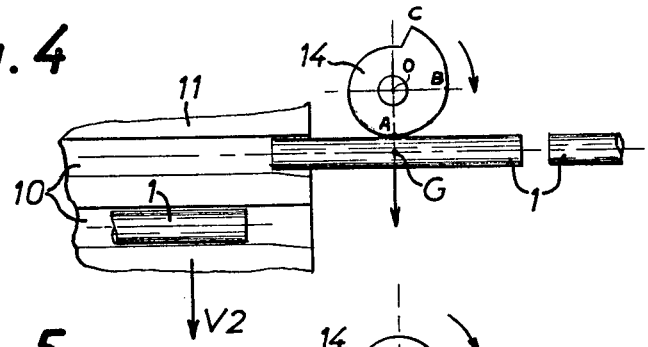
FIGS. 4, 5 and 6 are views similar to FIG. 3 but showing the various subsequent steps of the cam operation, from the beginning to the end thereof.
Figure 5:
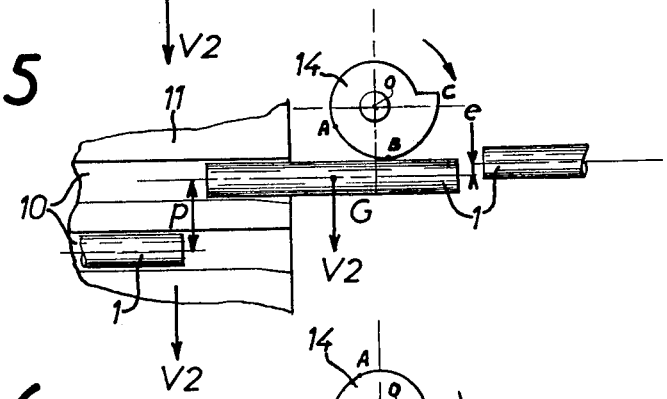
Figure 6:
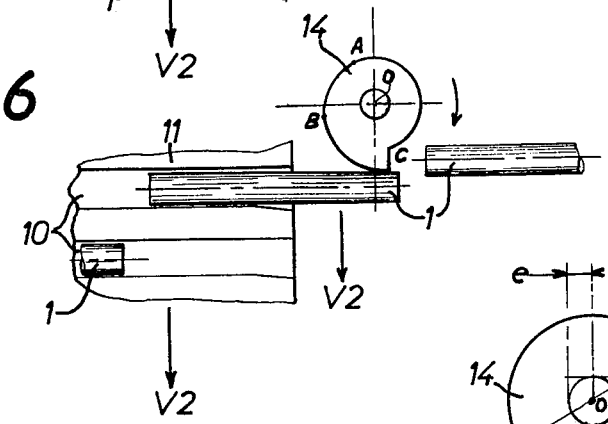

The origin A of the eccentric sector AB contacts the cigarette 1 when the increment from V to $V_1$ of the cigarette speed, imparted thereto by the endless tape 3, has detached the cigarette concerned from the next cigarette, when the leading end of the cigarette engages the groove 10, and when the center of gravity G of the cigarette is located straight under the axis of rotation of the cam, as illustrated in FIG. 4; the end B of this first profile AB leaves the cigarette before said centre of gravity G lies within the groove 10, as shown in FIG. 5, the cigarette having moved meanwhile longitudinally to the extent of about one-eighth of its length, and transversely by a distance "e" which is the throw of the centre 0' of the eccentric sector AB of cam 14 in relation to its axis of rotation 0; the end C of the cam profile leaves in turn the cigarette when the centre of gravity G thereof has penetrated into the groove 10 and the rear or trailing end of the cigarette is straight above the centre O of cam 14.

Then, the cigarette 1 continues to penetrate into the groove 10 of drum 12, the various peripheral grooves of the drum being disposed at spaced intervals corresponding to a pitch P.

To be satisfactory, the penetration of the cigarette into the relevant groove requires that the transverse velocity $V_2$ be equal to the peripheral velocity of the drum, that is:

$$2\,Ne = NP$$

which gives the eccentricity:

$$e = P/2\pi$$

If the machine is designed for processing cigarettes of variable length, notably cigarettes with or without filter tips, the penetration of these cigarettes into the grooves 10 of drum 11 cannot be satisfactory unless the distance D between the axis O of the eccentric disc 14 and the input face of drum 11 is adjustable as a function of the cigarette length. For this purpose, the case 16 of disc 14 is supported by a plate 18 adapted to be moved in a direction parallel to the cigarette axis on a support 19.

Throughout the travel illustrated in FIGS. 3 to 6 of the drawing, the cigarette remains pressed by the vacuum against the run 2 of tape 3 and therefore its longitudinal velocity $V_1$ is not slowed down.

Of course, it will readily occur to those conversant with the art that the form of embodiment of the invention described hereinabove with reference to the attached drawing should not be construed as limiting the present invention since many modifications and variations may be brought thereto without departing from the basic principles thereof. Thus, notably, changes may be contemplated as a function of the specific type of objects to be processed. In fact, though the transfer device of this invention is designed and intended more particularly for transferring cigarettes, it is clear that it can also be used for transferring other rod-like cylindrical objects and articles. Moreover, though a single cam 14 is illustrated and described herein, it will also occur to those conversant with the art that a multiple cam, i.e. a cam comprising several operative profiles A B C, for example two or three, may be used. In this case, the rotational velocity of the cam must not be N r.p.m. (N being the number of cigarettes produced by the machine in one minute), but a sub-multiple of N, such as N/2, N/3, etc..

What I claim is:

1. In a machine of the type producing a continuous rectilinear rod, comprising means for cutting this rod into sections constituting a continuous line of separate elongated cylindrical objects disposed in end to end relationship and travelling at a regular rate in their axial direction, a device for transferring said objects one by one transversely to said axial direction as they are received from the delivery means of said machine in successive recesses formed in a rotary drum of a conveyor for conveying these objects across said continuous line, said transfer device comprising a perforated endless tape of which one run is driven in a vertical plane at a velocity slightly greater than the rate of delivery of said objects, along one side of said objects, means for producing a vacuum on the inner side of said run so as to urge said objects against the external side of said run, between said delivery means and said conveyor, and rotary cam means disposed above said objects engaging said run and mounted for rotation about an axis perpendicular to said axial direction at a peripheral velocity slightly greater than that of said perforated tape run and therefore of the objects urged against said run while exerting a slight downward pressure on each object as it move under said cam means while a cigarette remains parallel to itself and tangent to said conveyor drum, until the object penetrates into the relevant recess of said drum, wherein said cam means comprise a single cam member of which the position in relation to said drum and the angular timing are such that the operative portion of the cam profile engages the uppermost generatrix of each object only when the axis of the elongated cylindrical object is aligned with the axis of the corresponding recess to be penetrated by the object, and that the leading end of the object is already engaged into said recess, whereby, as a consequence of the combined action of said cam and said recess, the object remains constantly parallel to itself throughout its transverse transfer and until it is received completely in said recess.

2. A device as claimed in claim 1, wherein said machine is a cigarette making machine and said objects are cigarettes cut from a continuous rectilinear rod of tobacco wrapped in a paper sheet.

3. A device as claimed claim 2, wherein the position of said cam member in relation to said recessed drum is such that the operative portion of the cam profile engages the uppermost generatrix of the cigarette when the centre of gravity of the cigarette is straight under the axis of rotation of said cam member.

4. A device as claimed in claim 3, whereinsaid cam member is driven at a number of r.p.m. equal to the number of cigarettes manufactured by the machine in one minute.

5. A device as claimed in claim 4, wherein the operative portion of the cam profile comprises a first sector consisting of a curve, for example an eccentric sector, such that it can impart to the cigarette a gradually increasing transverse velocity becoming eventually substantially equal to the peripheral velocity of the drum recesses.

6. A device as claimed in claim 5, wherein said first cam sector is followed by a second sector merging tangentially with the first sector and consisting of a curve, such as an involute of a curve, whereby the transverse velocity imparted to the cigarette remains constant and equal to the peripheral velocity of the drum, at least until said cigarette has penetrated into the corresponding drum recess to a depth such that a vertical plane containing the centre of gravity of the cigarette lies within the limits of said drum.

* * * * *